US005662864A

United States Patent [19]

Kato et al.

[11] Patent Number: 5,662,864

[45] Date of Patent: Sep. 2, 1997

[54] FE-CR ALLOY EXHIBITING EXCELLENT RIDGING RESISTANCE AND SURFACE CHARACTERISTICS

[75] Inventors: Yasushi Kato; Takumi Ujiro; Susumu Sato; Koji Yamato, all of Chiba, Japan

[73] Assignee: Kawasaki Steel Corporation, Hyogo, Japan

[21] Appl. No.: 696,619

[22] Filed: Aug. 14, 1996

[30] Foreign Application Priority Data

Aug. 14, 1995 [JP] Japan ..... 7-206972

[51] Int. Cl.[6] ..... C22C 38/28; C22C 30/00; C22C 27/06

[52] U.S. Cl. ..... 420/70; 420/428; 420/583

[58] Field of Search ..... 420/70, 428, 583; 148/325

[56] References Cited

U.S. PATENT DOCUMENTS

| | | |
|---|---|---|
| 3,455,681 | 7/1969 | Maskowitz et al. . |
| 4,282,291 | 8/1981 | Demo, Jr. . |

FOREIGN PATENT DOCUMENTS

| | | | |
|---|---|---|---|
| 0 306 578 | 3/1989 | European Pat. Off. . | |
| 53-99025 | 8/1978 | Japan | 148/325 |
| 2-61033 | 3/1990 | Japan . | |
| 3-287744 | 12/1991 | Japan . | |
| 5-78751 | 3/1993 | Japan . | |

*Primary Examiner*—Deborah Yee
*Attorney, Agent, or Firm*—Young & Thompson

[57] ABSTRACT

It is directed to provide an Fe—Cr alloy exhibiting an excellent ridging resistance and surface characteristic, comprising:

0.01% (percent by weight; the same as below) or less of C;

1.0% or less of Si;

1.0% or less of Mn;

0.01 or less of S;

9% or more to 50% or less of Cr;

0.07% or less of A1;

0.02% or less of N;

0.01% or less of O; and the balance being Fe and inevitable impurities;

wherein the C and N contents satisfy the following equations:

$$N(\%)/C(\%) \geqq 2,$$

and $$0.006 \leqq [C(\%)+N(\%)] \leqq 0.025;$$

and the Ti content satisfy the following equations:

$$\{Ti(\%)-2\times S(\%)-3\times O(\%)\}/[C(\%)+N(\%)] \leqq 4,$$

and $$[Ti(\%)]\times[N(\%)] \leqq 30\times10^{-4}.$$

2 Claims, 2 Drawing Sheets

FE-CR ALLOY EXHIBITING EXCELLENT RIDGING RESISTANCE AND SURFACE CHARACTERISTICS

BACKGROUND OF THE INVENTION

1. Field of the Invention

The present invention relates to an Fe—Cr alloy, exhibiting excellent ridging resistance, corrosion resistance and workability, for steel sheet having excellent surface characteristics.

2. Description of the Related Art

Fe—Cr alloys, such as ferrite stainless steels, having excellent characteristics, e.g. high corrosion resistance and thermal resistance, are widely used in various industrial fields, such as household articles and automobile parts. Because such alloys, however, have drawbacks in workability, and in detail, ridging, in other words, a surface defect like rough dry skin readily forms during press working of the thin steel plate, for example, such alloys are not suitable for the usage in which heavy working, such as deep drawing, are applied.

Many attempts have been proposed to solve the drawbacks set forth above. For example, Japanese Unexamined Patent Publication No. 52-24913 discloses the improvement in ridging resistance by a specified composition, i.e., a ferrite stainless steel exhibiting excellent workability which comprises 0.03 to 0.08% by weight of C (hereinafter "% by weight" is expressed as merely "%"), 0.01% or less of N, 0.008% or less of S, 0.03% or less of P, 0.4% or less of Si, 0.5% or less of Mn, 0.3% or less of Ni, 15 to 20% of Cr, 2×N to 0.2% of Al, and the balance Fe and inevitable impurities. Further, Japanese Unexamined Patent Publication No. 7-18385 discloses an Fe—Cr alloy exhibiting excellent ridging resistance which comprises 3 to 60% of Cr, decreased amounts of C, S and O, 0.003 to 0.5% of N, and the balance Fe and inevitable impurities. In such prior art, although the ridging resistance is improved by specifying the components, characteristics other than the ridging resistance are unsatisfactory.

Additionally, Japanese Unexamined Patent Publication No. 55-141522 discloses a method for making a ferrite stainless steel with decreased ridging by performing hot rolling in which the slab heating temperature is limited to the range of 950° to 1,100° C. Although the prior art intends to decrease ridging by fining crystal grains at a lower slab heating temperature, defects at the steel surface significantly increase since the heating temperature is lower than the rolling temperature.

In the prior art, although ridging resistance has been improved to some extent as set forth above, such an improvement is not satisfactory in practical uses. Further, no material exhibiting excellent characteristics, e.g. workability, such as elongation and r value, and surface characteristics, such as corrosion resistance and packed scab, has been proposed.

SUMMARY OF THE INVENTION

It is an object of the present invention to provide an Fe—Cr alloy, exhibiting a significantly improved ridging resistance and excellent corrosion resistance and workability, for steel sheet having excellent surface characteristics.

An Fe—Cr alloy in accordance with the present invention, exhibiting an excellent ridging resistance and surface characteristics, comprises:

0.01% (percent by weight; the same as below) or less of C;

1.0% or less of Si;

1.0% or less of Mn;

0.01 or less of S;

9% or more to 50% or less of Cr;

0.07% or less of Al;

0.02% or less of N;

0.01% or less of O; and the balance being Fe and inevitable impurities;

wherein the C and N contents satisfy the following equations:

$$N(\%)/C(\%) \geqq 2,$$

and $$0.006 \leqq [C(\%)+N(\%)] \leqq 0.025;$$

and the Ti content satisfies the following equations:

$$\{Ti(\%)-2\times S(\%)-3\times O(\%)\}/[C(\%)+N(\%)] \leqq 4,$$

and $$[Ti(\%)]\times[N(\%)] \leqq 30\times 10^{-4}.$$

The Fe—Cr alloy in accordance with the present invention preferably further contains at least one element selected from the group consisting of Ca, Mg, and B in an amount of 0.0003 to 0.005 weight percent.

DETAILED DESCRIPTION OF THE PREFERRED EMBODIMENTS

Figure 1:
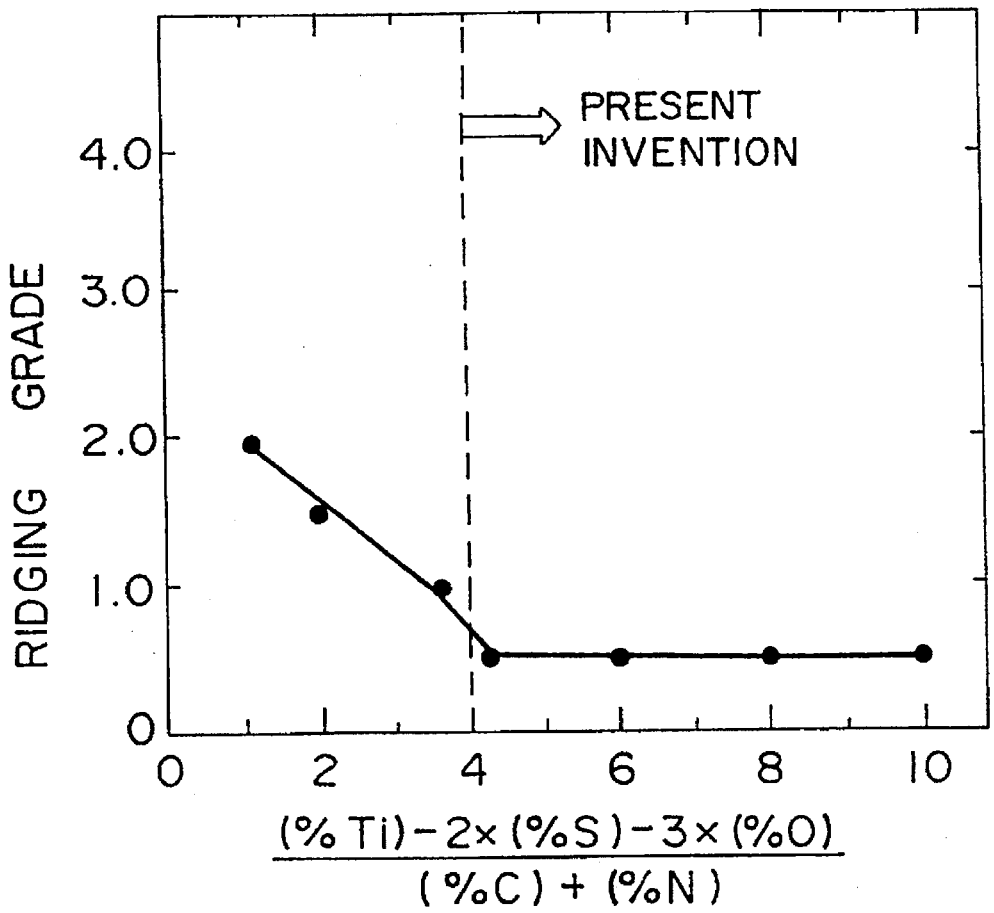
FIG. 1 is a graph showing the correlation between the ridging resistance and the {Ti(%)−2×S(%)−3×O(%)}/[C(%)+N(%)] value.

The present inventors have intensively investigated the achievement of the objects set forth above, and in particular, the improvement in ridging resistance. First, experiments which have led to the present invention will be explained.

The ridging resistance was evaluated with various thin sheets in which the Ti content is varied in the base composition comprising 16.4% of Cr—Fe alloy containing 0.0032% of C, 0.38% of Si, 027% of Mn, 0.003% of S, 0.005% of O and 0.017% of Al. A JIS No. 5 tensile test piece was prepared from each thin sheet, 20% of tensile strain was added to the test piece, each maximum roughness ($R_{max}$) in the direction perpendicular to the tensile direction was measured by a surface coarseness meter. The evaluation of ridging resistance was based on the following standard:

Ridging grade 0.5: R max<5 μm

Ridging grade 1.0:5 μm≦Rmax<10 μm

Ridging grade 1.5:10 μm≦Rmax<15 μm

Ridging grade 2.0:15 μm≦Rmax<30 μm

Ridging grade 2.5:30 μm≦Rmax

The smaller ridging grade means smaller ridging size.

The results are shown in FIG. 1. FIG. 1 demonstrates that the ridging resistance significantly improves, i.e., the ridging grade is 1.0 or less when the value of {Ti(%)−2×S(%)−3×O(%)}/[C(%)+N(%)] is 4 or more. The improvement in ridging resistance is due to the carbonitride formed by adding Ti in response to the C+N content.

Figure 2:
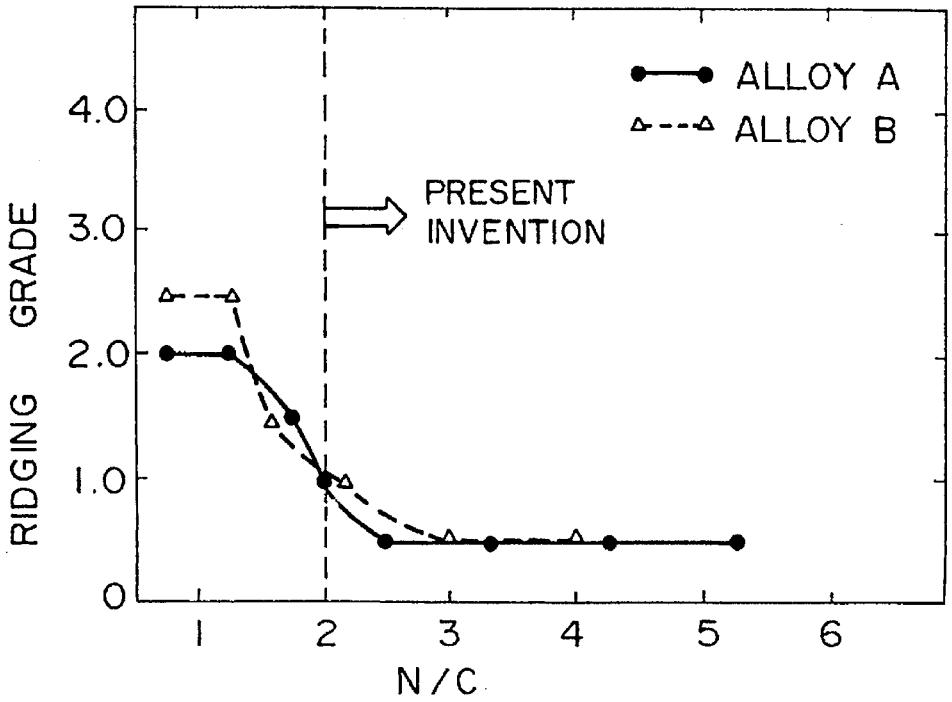
FIG. 2 is a graph showing the correlation between the ridging resistance and the N/C ratio.

Next, the ridging resistance was evaluated with thin sheets each comprising either of 17.1 to 17.3% of Cr—Fe alloy (Alloy A) containing 0.41 to 0.55% of Si, 0.15 to 0.30% of Mn, 0.001 to 0.003% of S, 0.003 to 0.005% of O, and 0.011 to 0.015% of Al, or 22.5 to 22.7 % of Cr—Fe alloy (Alloy B) containing 0.35 to 0.45% of Si, 0.50 to 0.65% of Mn, 0.002 to 0.004% of S, 0.004 to 0.006% of O, and 0.011 to 0.015% of Al. Further, the C and N contents are controlled so that {Ti(%)−2×S(%)−3×O(%)}/[C(%)+N(%)] ranges within 4 to 10. Results are shown in FIG. 2. FIG. 2 demonstrates that ridging resistance is not satisfactory at a N/C ratio of less than 2 even if the Ti content is controlled, and is improved up to a ridging grade of 1 or less at a N/C ratio of 2 or more.

Figure 3:
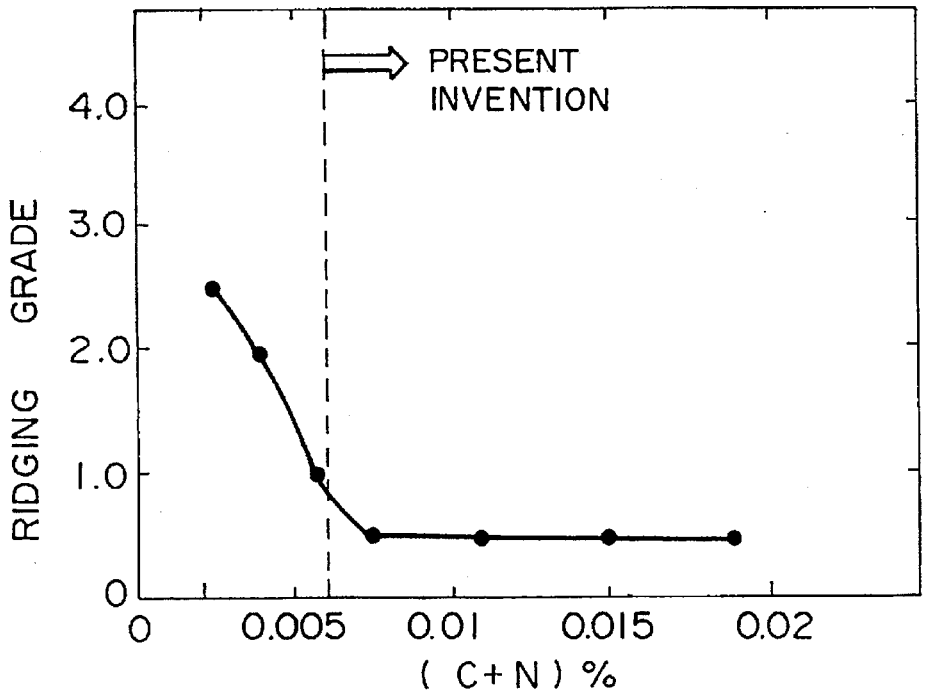
FIG. 3 is a graph showing the correlation between the ridging resistance and the (C+N) content.

Additionally, the ridging resistance is evaluated with various thin sheets which comprise a 17.8% Cr—Fe base alloy containing 0.41% of Si, 0.37% of Mn, 0.004% of S, 0.005% of O, and 0.011% of Al, the Ti content is controlled so that {Ti(%)−2×S(%)−3×O(%)}/[C(%)+N(%)] ranges within 6.5 to 7.5, the N/C ratio is 2 or more, and the C+N content is varied. The results are shown in FIG. 3. FIG. 3 demonstrates that the ridging resistance is improved when the N/C ratio is 2 or more and the C+N content is 0.006% or more with a controlled Ti content.

The improvement in the ridging resistance can be achieved only when all of the Ti content, the C+N content and the N/C ratio satisfy the conditions set forth above. The present invention is achieved based on the experiments set forth above.

The reason of the limitation of the contents of various elements in the present invention will now be explained.

C: 0.01% or less

The carbon (C) content is an important factor in the present invention. A lower carbon content is preferable in consideration of workability, e.g. elongation and r-value, and corrosion resistance. When the C content exceeds 0.01%, the above characteristics are deteriorated. Thus, the upper limit of the C content is set to be 0.01%.

Si: 1.0% or less

Silicon acts as a deoxidizer and increases the strength, whereas a Si content exceeding 1% causes a decrease in ductility. Thus, the upper limit of the Si content is set to be 1.0%, and the Si content is more preferably 0.05 to 0.7% in consideration of strength and ductility.

Mn: 1.0% or less

Manganese (Mn) acts as a deoxidizer and increases the strength, whereas a Mn content exceeding 1% causes a decrease in ductility and corrosion resistance. Thus, the upper limit of the Mn content is set to be 1.0%, and the Mn content is more preferably 0.05 to 0.7% in consideration of strength and corrosion resistance.

S: 0.01% or less

Sulfur (S) generally forms inclusions adversely affecting the material quality and decreasing corrosion resistance, in particular, pitting corrosion resistance. Further, S reacts with the added Ti to form TiS, and thus decreases the amount of Ti effectively reacting with C and N. Thus, a lower S content is preferable. The upper limit is set to be 0.01% and more preferably 0.006%, because the effects set forth above are noticeable when the S content exceeds the limit.

Cr: 9% or more to 50% or less

Chromium (Cr) is an element for effectively improving the corrosion resistance and heat resistance of the alloy and is required in an amount of at least 9%. On the other hand, a Cr content exceeding 50% causes difficulty in production by rolling. Thus, the Cr content is set to be 9% to 50%.

Al: 0.07% or less

Aluminum (Al) acts as a deoxidizer, and forms large inclusions when Al is added in an amount exceeding 0.07%, resulting in a decrease in corrosion resistance and the formation of scabs on the sheet surface. Thus, the upper limit is set to be 0.07%, and more preferably 0.05% in consideration of slag spot (slag inclusion) formation during welding.

N: 0.02% or less

The nitrogen (N) content is an important factor, and a lower N content is preferable for workability, e.g. elongation and r-value, and corrosion resistance. The upper limit is set to be 0.02%, because a content exceeding the upper limit causes the deterioration of such characteristics.

O: 0.01% or less

Because oxygen (O) is an impurity, it is preferred that the O content is as low as possible. Much oxygen forms inclusions to decrease corrosion resistance and to cause scabs on the sheet surface. Thus, the upper limit of the O content is set to be 0.01%.

$$N(\%)/C(\%) \geqq 2,$$

and $$0.006 \geqq [C(\%)+N(\%)] \geqq 0.025$$

The correlation between the C and N contents must be limited for improving the ridging resistance as the primary object of the present invention. The ridging resistance significantly improves when the ratio of the N content to the C content is 2 or more. Thus, the N/C ratio is set to be 2 or more. Further, when the C+N content is less than 0.006%, the ridging resistance does not noticeably improve even if the N/C ratio is 2 or more. On the other hand, a C+N content exceeding 0.025% causes a decrease in elongation and r-value. Thus, the lower and upper limits of the C+N content are set to be 0.006% and 0.025%, respectively.

$$\{Ti(\%)-2\times S(\%)-3\times O(\%)\}/[C(\%)+N(\%)] \geqq 4,$$

and $$[Ti(\%)]\times[N(\%)] \geqq 30\times10^{-4}$$

Titanium (Ti) is a primary element in the present invention and forms carbonitride to enhance the ridging resistance. At the same time, Since Ti readily reacts with S and O, the Ti content must be set in consideration of the formation of TiS and $TiO_2$. As set forth in FIG. 1, the ridging grade is 1.0 or less, when {Ti(%)−2×S(%)−3×O(%)}/[C(%)+N(%)] is 4 or more. When the value is less than 4, the ridging grade is more than 1.0, i.e., the ridging resistance does not noticeably improve. The lower limit of the Ti content depends on the C, N, S and O contents, and is preferably 0.05% in consideration of the ridging resistance. By adding a large amount of Ti, stringer-type defects form on the sheet surface probably due to the precipitation of coarse TiN grains. Thus, the ripper limit of the Ti content is set so as to satisfy the equation:

$$[Ti(\%)]\times[N(\%)] \geqq 30\times10^{-4}.$$

At least one element of Ca, Mg and B: 0.0003 to 0.005%

A trace amount of the addition of Ca, Mg and/or B can effectively prevent clogging of the immersion nozzle due to the precipitation of Ti inclusions which readily form in a continuous casting step of Ti-containing steel. Such an effect is noticeable when at least one element is added in an amount exceeding 0.0003%. On the other hand, a content exceeding 0.005% significantly decreases corrosion resistance and, in particular, pitting corrosion resistance. Thus, the lower and upper limits of the content of at least one element of Ca, Mg and B are set to be 0.0003% and 0.005%, respectively.

The balance is Fe and inevitable impurities. Ni, V, Mo, Nb, and Cu can be included as inevitable impurities within their respective allowable ranges, i.e., Ni≦0.3%, V≦0.3%, Mo≦0.3%, Nb≦0.02%, and Cu≦0.3%.

The P content must be suppressed as much as possible, and preferably to be 0.05% or less, because P causes the embrittlement of the alloy.

The Fe—Cr alloy in accordance with the present invention can be produced by any process described below for exemplification, but not for limitation. Steel making processes include RH degassing and VOD (vacuum oxygen decarburization) processes, casting processes preferably include continuous casting in consideration of productivity and quality. Any hot rolling and cold rolling processes may be employed to obtain a desired sheet thickness. Various products, such as hot rolling sheets, cold rolling sheets, welding pipes, seamless pipes, and their surface treated products, are available with the present invention.

EXAMPLES

The Fe—Cr alloy in accordance with the present invention will now be explained based on Examples.

Example 1

From Fe—Cr alloys each having a composition as given in Table 1, approximately 200-mm thick slabs were prepared by RH degassing and/or VOD processes, and a continuous casting process. Each slab was heated to 1,120° to 1,240° C. and then was subjected to hot rolling to form a hot-rolled sheet having a thickness of 4 mm at a finishing rolling temperature of 770° to 900° C. Each hot-rolled sheet was annealed for recrystallization at 800° to 1,000° C., descaled with an acid, and subjected to cold rolling to obtain a cold-rolled sheet having a thickness of 1.0 mm. The cold-rolled sheet was again annealed for recrystallization at 800° to 1,000° C., descaled with an acid, and subjected to various tests. The test results are shown in Table 1. The surface finishing was based on 2B specified in JIS. Each test was based on the following procedures:

(1) Ridging Resistance

A JIS No. 5 tensile strength test piece of each sample was prepared from its respective sheet for ridging resistance evaluation. The ridging resistance was evaluated in terms of the ridging point as set forth above. A smaller ridging point means a smaller ridging (or higher ridging resistance).

(2) r-Value

Three test pieces for JIS No. 13B tensile strength test were prepared by cutting the sheet in L, C, and 45 degree directions, respectively. The r-values in three directions of each test piece were measured with 15% tensile strain. The r-value in Table 1 is the average of r-values in three directions.

(3) Surface Characteristics

Stringer-type defects on the sheet surface were visually observed. The evaluation was base on the following standard:

A: No defect (Good surface characteristic)

B: Slight defect (Slightly impaired surface characteristics)

C: Many defects (Poor surface characteristics)

Results in Table 1 demonstrate that each sample in accordance with the present invention exhibits an excellent ridging resistance and surface characteristics, as well as a higher r-value.

TABLE 1

Unit: weight %

| No. | C | Si | Mn | S | Cr | Al | N | O | Ti | Remarks |
|---|---|---|---|---|---|---|---|---|---|---|
| 1 | 0.0074 | 0.45 | 0.33 | 0.004 | 10.8 | 0.015 | 0.0153 | 0.007 | 0.14 | Present |
| 2 | 0.0028 | 0.18 | 0.28 | 0.006 | 15.6 | 0.038 | 0.088 | 0.003 | 0.19 | Invention |
| 3 | 0.0038 | 0.66 | 0.40 | 0.002 | 16.3 | 0.004 | 0.0097 | 0.002 | 0.21 | |
| 4 | 0.0022 | 0.52 | 0.32 | 0.001 | 16.8 | 0.055 | 0.0133 | 0.004 | 0.16 | |
| 5 | 0.0051 | 0.38 | 0.19 | 0.003 | 17.2 | 0.007 | 0.0144 | 0.005 | 0.19 | |
| 6 | 0.0047 | 0.09 | 0.58 | 0.005 | 21.4 | 0.014 | 0.0129 | 0.004 | 0.16 | |
| 7 | 0.0026 | 0.12 | 0.22 | 0.004 | 30.3 | 0.028 | 0.0061 | 0.006 | 0.09 | |
| 8 | 0.0038 | 0.57 | 0.39 | 0.007 | 16.4 | 0.015 | 0.0041 | 0.004 | 0.18 | Comparative |
| 9 | 0.0014 | 0.44 | 0.28 | 0.004 | 16.9 | 0.011 | 0.0037 | 0.004 | 0.13 | Examples |
| 10 | 0.0033 | 0.51 | 0.48 | 0.004 | 16.9 | 0.007 | 0.0084 | 0.006 | 0.06 | |
| 11 | 0.0079 | 0.15 | 0.22 | 0.003 | 17.4 | 0.018 | 0.0188 | 0.004 | 0.24 | |
| 12 | 0.0039 | 0.44 | 0.09 | 0.004 | 21.6 | 0.011 | 0.0094 | 0.006 | 0.43 | |

| No. | N/C | C + N | Y-value* | Ti × N | Ridging Grade | r-value | Surface defect | Remarks |
|---|---|---|---|---|---|---|---|---|
| 1 | 2.07 | 0.0227 | 4.89 | 0.002142 | 0.5 | 1.9 | A | Present |
| 2 | 3.14 | 0.0116 | 14.6 | 0.001672 | 0.5 | 1.8 | A | Invention |
| 3 | 2.55 | 0.0135 | 14.8 | 0.002037 | 0.5 | 1.8 | A | |
| 4 | 6.05 | 0.0155 | 9.42 | 0.002128 | 0.5 | 1.8 | A | |
| 5 | 2.82 | 0.0195 | 8.67 | 0.002736 | 0.5 | 1.8 | A | |
| 6 | 2.74 | 0.0176 | 7.84 | 0.002064 | 0.5 | 1.6 | A | |
| 7 | 2.35 | 0.0087 | 7.36 | 0.000549 | 0.5 | 1.5 | A | |
| 8 | 1.08 | 0.0079 | 19.5 | 0.000738 | 2.0 | 1.5 | A | Comparative |
| 9 | 2.64 | 0.0051 | 21.6 | 0.000481 | 1.25 | 1.8 | A | Examples |
| 10 | 2.55 | 0.0117 | 2.91 | 0.000504 | 1.5 | 1.3 | A | |
| 11 | 2.38 | 0.0267 | 8.31 | 0.004512 | 1.25 | 1.3 | C | |
| 12 | 2.41 | 0.0133 | 30.4 | 0.004042 | 0.5 | 1.3 | B | |

*Y-value = {Ti(%) −2 × S(%) −3 × O(%)}/{C(%) + N(%)}

Example 2

From Fe—Cr alloys each having a composition as given in Table 2, approximately 200-mm thick slabs were prepared by RH degassing and/or VOD processes, and a continuous casting process. Clogging of the immersion nozzle in the continuous casting was evaluated with the K-value [=1−(inner diameter of immersion nozzle after casting)/(inner diameter of immersion nozzle before casting)] at a casting weight of 50 ton. Each slab was subjected to hot rolling, annealing, descaling with acid, cold rolling and then descaling With acid to obtain a cold-rolled sheet having a thickness of 1.0 mm. Surface finishing was 2B.

Each cold-rolled sheet was subjected to SST (salt solution spraying test according to JIS-Z-2371) at 50° C. for 50 hours using a 5% aqueous NaCl solution. Corrosion formed on the sheet surface was visually observed. The evaluation was based on the number of corrosion points formed in 100 $cm^2$ according to the following ranking:

A: Corrosion points 2 or less

B: Corrosion points 3 to 15

C: Corrosion points 16 or more

Results are shown in Table 2.

In Example 2, clogging of the immersion nozzle is not substantially observed and corrosion resistance is excellent.

As set forth above, the present invention can provide an Fe—Cr alloy which exhibits excellent ridging resistance compared with prior art alloys, and excellent corrosion resistance, workability, and surface characteristics. Thus, the alloy is applicable to working parts which cannot be made of prior art alloys.

TABLE 2

Unit: weight %

| No. | C | Si | Mn | S | Cr | Al | N | O | Ti | Ca | B | Mg | Remarks |
|---|---|---|---|---|---|---|---|---|---|---|---|---|---|
| 13 | 0.0061 | 0.27 | 0.19 | 0.004 | 11.2 | 0.022 | 0.0153 | 0.005 | 0.17 | 0.0011 | — | — | Present |
| 14 | 0.0028 | 0.07 | 0.18 | 0.005 | 16.1 | 0.034 | 0.0091 | 0.003 | 0.19 | — | 0.0007 | — | Invention |
| 15 | 0.0038 | 0.58 | 0.33 | 0.002 | 16.4 | 0.005 | 0.0097 | 0.002 | 0.21 | — | — | 0.0018 | |
| 16 | 0.0028 | 0.44 | 0.60 | 0.006 | 18.5 | 0.044 | 0.0133 | 0.004 | 0.16 | 0.0007 | — | 0.0006 | |
| 17 | 0.0048 | 0.31 | 0.19 | 0.003 | 20.5 | 0.007 | 0.0144 | 0.005 | 0.17 | 0.0019 | 0.0005 | — | |
| 18 | 0.0045 | 0.23 | 0.22 | 0.005 | 16.5 | 0.018 | 0.0102 | 0.006 | 0.19 | — | 0.0058 | — | Compara- |
| 19 | 0.0038 | 0.29 | 0.19 | 0.003 | 16.8 | 0.026 | 0.0112 | 0.004 | 0.18 | 0.0058 | — | — | tive |
| 20 | 0.0021 | 0.24 | 0.27 | 0.004 | 16.3 | 0.022 | 0.0094 | 0.003 | 0.20 | — | — | 0.0058 | Examples |
| 21 | 0.0038 | 0.57 | 0.39 | 0.007 | 16.4 | 0.015 | 0.0041 | 0.004 | 0.18 | — | — | — | |
| 22 | 0.0014 | 0.44 | 0.28 | 0.004 | 16.9 | 0.011 | 0.0037 | 0.004 | 0.13 | 0.0058 | — | — | |
| 23 | 0.0033 | 0.51 | 0.48 | 0.004 | 16.9 | 0.007 | 0.0084 | 0.006 | 0.06 | — | 0.0001 | — | |

| No. | N/C | C + N | Y-value* | Ti × N | Ridging Grade | K-value | Corrosion Resistance | Remarks |
|---|---|---|---|---|---|---|---|---|
| 13 | 2.51 | 0.0214 | 6.87 | 0.002601 | 0.5 | 0.05 | A | Present |
| 14 | 3.25 | 0.0119 | 14.4 | 0.001729 | 0.5 | 0.04 | A | Invention |
| 15 | 2.55 | 0.0135 | 14.8 | 0.002037 | 0.5 | 0.04 | A | |
| 16 | 4.75 | 0.0161 | 8.45 | 0.002128 | 0.5 | 0.05 | A | |
| 17 | 3.00 | 0.0192 | 7.76 | 0.002448 | 0.5 | 0.07 | A | |
| 18 | 2.27 | 0.0147 | 11.0 | 0.001938 | 0.5 | 0.06 | C | Comparative |
| 19 | 2.95 | 0.0150 | 10.8 | 0.002016 | 0.5 | 0.04 | C | Examples |
| 20 | 4.48 | 0.0115 | 15.9 | 0.000188 | 0.5 | 0.05 | C | |
| 21 | 1.08 | 0.0079 | 19.5 | 0.000738 | 2.0 | 0.7 | A | |
| 22 | 2.64 | 0.0051 | 21.6 | 0.000481 | 1.25 | 0.04 | C | |
| 23 | 2.55 | 0.0117 | 2.91 | 0.000504 | 1.5 | 0.38 | B | |

*Y-value = {Ti(%) −2 × S(%) −3 × O(%)}/{C(%) + N(%)}

What is claimed is:

1. An Fe—Cr alloy exhibiting an excellent ridging resistance and surface characteristic, comprising:

0.01% (percent by weight; the same as below) or less of C;

1.0% or less of Si;

1.0% or less of Mn;

0.01 or less of S;

9% or more to 50% or less of Cr;

0.07% or less of Al;

0.02% or less of N;

0.01% or less of O; and the balance being Fe and inevitable impurities;

wherein the C and N contents satisfy the following equations:

$$N(\%)/C(\%) \geqq 2.07$$

and $$0.007 \leqq [C(\%)+N(\%)] \leqq 0.025;$$

and the Ti content satisfy the following equations:

$$\{Ti(\%)-2\times S(\%)-3\times O(\%)\}/[C(\%)+N(\%)] \geqq 4,$$

and $$[Ti(\%)]\times[N(\%)] \leqq 30\times 10^{-4}.$$

2. An Fe—Cr alloy according to claim 1, wherein said alloy further contains at least one element selected from the group consisting of Ca, Mg, and B in an amount of 0.0003 to 0.005 weight percent.

* * * * *

UNITED STATES PATENT AND TRADEMARK OFFICE

CERTIFICATE OF CORRECTION

PATENT NO. : 5,662,864

DATED : September 2, 1997

INVENTOR(S) : Yasushi KATO et al.

It is certified that error appears in the above-indentified patent and that said Letters Patent is hereby corrected as shown below:

On the title page, Item [57], in the abstract, line 8, change "0.01" to --0.01%--;

line 21, change "≦" to --≧--.

In column 2, line 5, change "0.01" to --0.01%--;

line 25, change "≦" to --≧--.

In column 8, line 63, change "0.01" to --0.01%--.

Signed and Sealed this

Twentieth Day of January, 1998

*Attest:*

*Attesting Officer*

BRUCE LEHMAN

*Commissioner of Patents and Trademarks*